United States Patent [19]

Chauvier

[11] 4,193,156

[45] Mar. 18, 1980

[54] APPARATUS FOR CLEANING SUBMERGED SURFACES

[75] Inventor: Fernand L. O. J. Chauvier, Springs, South Africa

[73] Assignee: Daniel Jean Velere Denis Chauvier, Dunnottar, South Africa

[21] Appl. No.: 963,529

[22] Filed: Nov. 24, 1978

Related U.S. Application Data

[62] Division of Ser. No. 823,757, Aug. 11, 1977, Pat. No. 4,156,948.

[30] Foreign Application Priority Data

Aug. 19, 1976 [ZA] South Africa ..... 76/4992
Oct. 13, 1976 [ZA] South Africa ..... 76/6105

[51] Int. Cl.[2] ..... E04H 3/20
[52] U.S. Cl. ..... 15/1.7; 15/420
[58] Field of Search ..... 15/1.7, 319, 320, 321, 15/322, 338, 375, 397, 399, 415, 417–422

[56] References Cited

U.S. PATENT DOCUMENTS

| | | | |
|---|---|---|---|
| 2,243,935 | 6/1941 | Williamson | 15/338 X |
| 3,605,171 | 9/1971 | Candor et al. | 15/420 |
| 4,023,227 | 5/1977 | Chauvier | 15/1.7 |

*Primary Examiner*—Edward L. Roberts
*Attorney, Agent, or Firm*—Wood, Herron & Evans

[57] ABSTRACT

This invention provides improvements to apparatus for automatically cleaning surfaces submerged in a liquid. Thus, there is provided an apparatus having a pivotally displaceable float by means of which the apparatus is caused to turn around when migrating up an upright surface so as not to break the surface of the liquid. The pivotal axis of the float is further tiltable, a tilting float being provided to tilt the pivotal axis to assist in displacing the float. The apparatus further has a sealing flange which has perimetral concertina-like folds so as to be resiliently extensible. Still further, the apparatus has a cleaning head, the region thereof that engages the surface to be cleaned having zones with differing frictional characteristics to cater for various surfaces. In a preferred embodiment this is effected by providing sockets in the cleaning head in which studs having the required frictional characteristics are secured.

1 Claim, 2 Drawing Figures

APPARATUS FOR CLEANING SUBMERGED SURFACES

Figure 1:
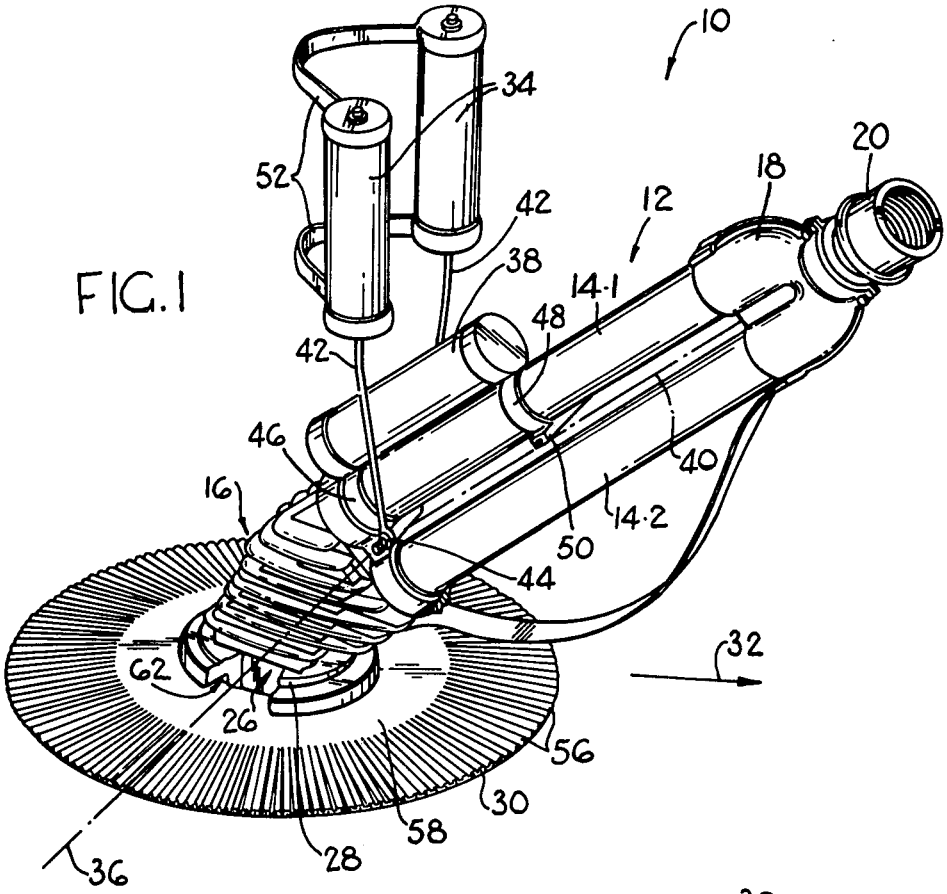

This is a division of application Ser. No. 823,757, filed Aug. 11, 1977, now U.S. Pat. No. 4,156,948.

BACKGROUND OF THE INVENTION

This invention relates to improvements in or relating to apparatus for cleaning submerged surfaces. More particularly the invention relates to apparatus that automatically displaces itself across horizontal and upright surfaces thereby to clean the surfaces. In a particular use of the apparatus it may be utilised for automatically cleaning the floor and walls of a swimming pool.

According to the invention there is provided an apparatus for cleaning a surface submerged in a liquid, the apparatus including a body adapted to be automatically displaced across the surface; and a main buoyancy member displaceably attached to the body so as to be automatically displaceable relative to the body by the buoyant forces which it, in use, experiences, in accordance with the attitude assumed by the body.

Conveniently, the buoyancy member may be pivotally attached to the body. For example, the buoyancy member may be attached to one end of a lever arm, the other end of which is pivotally attached to the body. Thus, the buoyancy member may be constrained to move in an arcuate manner laterally with respect to the body.

The buoyancy member may be restricted to be displaceable on only one side of the body. Alternatively, it may be free to move from one side of the body to the other.

The buoyancy member may follow a path that is suitably located with respect to the centre of gravity of the body. Further, the position or positions at which the buoyancy member exerts a buoyant force on the body may be suitably determined with reference to the centre of gravity of the body.

In a preferred embodiment, the body may have a head portion engageable with the surface to be cleaned, the lever arm being attached to the body towards the head portion thereof. Further, the pivotal axis may be horizontally disposed when the head portion is engaged with a horizontally disposed surface. Thus, when the head portion is engaged with the horizontally disposed surface, the main buoyancy member will pivot the lever arm such that the main buoyancy member is vertically disposed above the pivotal axis. When the apparatus moves onto a wall portion, such that the head portion is then engaged with a vertically or uprightly disposed surface, with the body extending upwardly from the head portion, the main buoyancy member will pivot towards the body portion. Then, if the body portion is canted over a predetermined extent, the buoyant force which the main buoyancy member experiences will cause it to pivot away from the body towards the head portion, exerting a force on the body which tends to lift the head portion, thereby displacing the effective centre of gravity of the apparatus away from the head portion.

The apparatus may be adapted such that the pivotal axis of the main buoyancy member is tiltable about a tilting axis relative to the body, the apparatus being provided with a tilting means for automatically varying the orientation of the pivotal axis relative to the body in accordance with the attitude assumed by the body. Preferably, the tilting axis is perpendicular to the pivotal axis.

As a preferred embodiment, the tilting means may comprise a tilting buoyancy member attached to the main buoyancy member so as to cause the pivotal axis to be tilted in accordance with the attitude assumed by the body. In order to minimise the extent to which the body must be canted over before the main buoyancy member pivots, the tilting buoyancy member may be adapted to tilt the pivotal axis out of a vertical plane when the head portion is engaged with a vertically disposed surface and the body is canted over to a predetermined extent.

Further, the tilting buoyancy member may be pivotally secured to the body, the lever arm then being pivotally fast with the tilting buoyancy member.

In an alternative form, the main buoyancy member could be attached to a cranked lever arm, the crank in the lever arm then constituting the tilting means.

According to a further aspect of the invention, there is provided a flange for an apparatus for cleaning a surface submerged in a liquid, the flange being attachable to the apparatus about a mouth portion thereof which is engageable with the surface to be cleaned, and the perimetral region, at least, of the flange being resiliently extensible.

The flange may conveniently be in the form of a flexible, substantially planar disc having a central aperture. Further, the perimetral region may be corrugated or wrinkled such that it may be resiliently extended, to thereby increase its effective surface area. Thus, the flange may have a number of concertina-like folds. These folds may radiate outwardly from a central region of the flange.

The flange may be of a suitable synthetic plastics material and may be moulded in a suitable mould.

Further according to this aspect, the invention extends to an apparatus for cleaning a surface submerged in a liquid, which includes a flange as indicated above.

According to a third aspect of the invention, there is provided a cleaning head for an apparatus for cleaning a surface submerged in a liquid, the cleaning head having a region engageable with the surface, which region has a plurality of zones having differing frictional characteristics.

By this means, the cleaning apparatus may operate effectively on a number of different surfaces, such as a metal surface, a concrete surface, a painted surface, a surface lined with a synthetic plastics material, or the like.

The zones may be provided with differing frictional characteristics either by providing the zones with different surface textures, or by forming them from different materials.

Still further, the invention extends to a cleaning head for an apparatus for cleaning a surface submerged in a liquid, the cleaning head having attachment means whereby surface engaging members, which engage, in use, the surface to be cleaned, may be attached to the cleaning head.

More particularly, the attachment means may comprise a plurality of sockets in which the surface engaging members are received. In this case, the surface engaging members may be in the form of studs or inserts which are insertable in the sockets. Such studs or inserts may be secured to the cleaning head in any suitable manner, for example frictionally or adhesively.

Finally, the invention extends to an apparatus for cleaning a surface submerged in a liquid, which includes a cleaning head in accordance with the invention.

Figure 2:
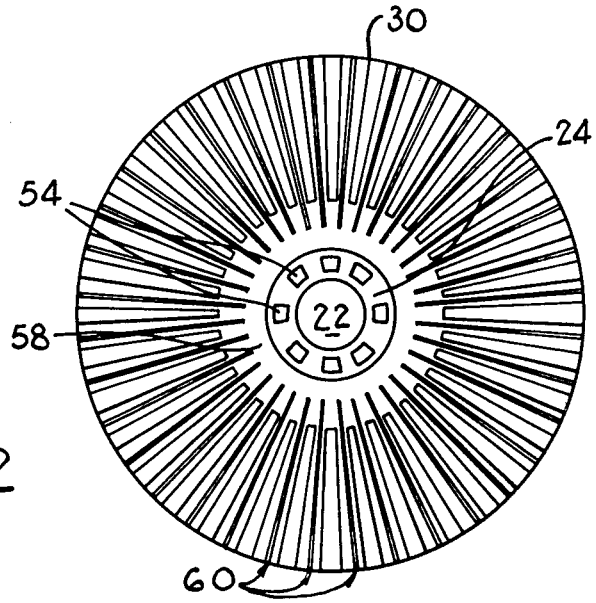

The invention is now described, by way of examples, with reference to the accompanying drawings, in which:

FIG. 1 shows a perspective view of an apparatus for automatically cleaning the walls and floor of a swimming pool, which is in accordance with the invention; and FIG. 2 shows an underneath plan view of the cleaning head and flange of the apparatus shown in FIG. 1.

Referring to the drawings, an apparatus for automatically cleaning the walls and floor of a swimming pool is designated generally by reference numeral 10. The apparatus 10 has a body 12 which comprises two pipes 14.1 and 14.2 secured at one end to a head 16 and at their other end to a junction member 18 which has a coupling 20 whereby the apparatus may be coupled to a flexible hose to be connected to a suction source (not shown). The head 16 is hollow having a mouth opening 22 in its underneath side 24 and main inflow openings 26 in its side walls 28. In use, the underneath side 24 is kept against the floor or wall of the swimming pool, as will be explained below. Around the mouth 22 is a flexible adhering disc 30 which assists in retaining the mouth 22 against the wall or floor. Within the head 16 is a valve member (not shown) which automatically and repeatedly transfers the flow of water flowing into the head 16 through the mouth 22 and the openings 26 from one pipe 14.1, 14.2 to the other. As a result of the transfer of flow between the pipes 14.1 and 14.2, the apparatus 10 is displaced across the wall or floor in the direction of the arrow 32, all as more particularly set forth in applicant's U.S. Pat. No. 4,023,227.

In order to control the manner in which the apparatus 10 is displaced, it also includes two main floats 34 that are pivotally displaceable together about a pivotal axis 36 and a tilting float 38 for tilting the pivotal axis 36 about a tilting axis 40. The main floats 34 are each secured to one end of lever arms 42, the other ends of which are pivotally attached to a pivot pin 44 which passes through a bracket 46 which pivotally secures the tilting float 38 to the pipe 14.1. As shown, a further bracket 48 is provided for securing the tilting float 38 to the pipe 14.1, so that the tilting float 38 is pivotable about the pipe 14.1. The brackets 46 and 48 have outwardly extending arms 50 which are engageable with the other pipe 14.2 to limit pivoting of the tilting float 38. The pivot pin 44 is secured in a bore provided in the arms 50 of the bracket 46. It will thus be appreciated, that as the tilting float 38 pivots about the pipe 14.1, the pivot pin 44 is caused to pivot about the tilting axis 40. The main floats 34 are secured together by two "U"-shaped connectors 52. As shown in FIG. 1, when the head 16 engages the floor of the swimming pool, the pivot pin 44 and the pivotal axis 36 are horizontally located. The floats 34 and the lever arms 42 will then adopt the position shown in FIG. 1.

In the underneath side 24 of the head 16 are sockets in which are adhesively secured inserts or studs 54. The inserts 54 are of a suitable material, chosen according to the surface of the floor and walls of the swimming pool, so that there is a desired co-efficient of friction between the inserts 54 and the walls and floor of the swimming pool. Thus, the inserts 54 suitable for a particular swimming pool are inserted in the sockets and secured to the head 16. Instead of providing inserts 54 of various materials, and securing the desired inserts 54 to the head 16, the head 16 may be provided with inserts 54 of differing materials, thereby to cater for a number of swimming pool surfaces.

The disc 30 is moulded from a suitable synthetic plastics material, in a suitable mould (not shown). The disc 30 is circular, annular, and substantially planar. It is further resiliently flexible and has a number of concertina-like, circumferentially spaced folds 56, each fold 56 extending radially. The folds 56 are provided in an outer annular perimetral portion of the disc 30, an inner annular portion 58 being substantially solid. Thus, the perimetral region of the disc 30 is resiliently extensible. On the underneath surface of the disc 30, a number of grooves 60 are provided. These grooves 60 extend from the outer extremity of the disc 30 into the inner annular portion 58. Further, the disc 30 has a central aperture, such that the disc 30 is received in a perimetral channel 62 in the head 16.

In use, suction is applied to the interior of the cleaning head 16, via the connecting hose and the pipes 14.1 and 14.2. This causes water to flow into the head 16, primarily through the main inflow openings 26. A certain amount of water flows into the head 16 through the mouth opening 22, but if the underneath side 24 of the head 16 is against the floor or wall of the swimming pool, this inflow is restricted a minimal amount of water flowing through the grooves 60. Due to the suction pressure within the head 16, and the surface area of the disc 30, the head 16 is kept against the floor or wall of the swimming pool. Due to the tranfer of flow between the pipes 14.1 and 14.2, the flow of water into the head 16 is automatically intermittently halted or decreased. When the flow of water is halted or decreased, the suction pressure in the head 16 is decreased, disengaging the head 16 frictionally from the wall or floor and the kinetic energy of the water flowing in the pipes 14.1 and 14.2 is transferred to the apparatus 10, displacing it across the wall or floor, all as more particularly described in applicant's U.S. Pat. No. 4,023,227. When the water again starts flowing through the head 16, it is pulled against the wall or floor and the inserts 54 frictionally engage the wall or floor, in a desired manner, so that the apparatus 10 is not displaced in the opposite direction.

When the apparatus 10 negotiates a transition region between the wall and floor, the outer annular region of the disc 30 extends, keeping the inflow of water into the mouth opening 22 to a minimum, and ensuring that the apparatus 10 is kept against the floor or wall as required. Due to the restricted cross-sectional area of the grooves 60, any water flowing through them flows at a substantial speed, assisting in removing dust from the floor and wall, particularly any dust located in a corner between the floor and wall.

The purpose and operation of the floats 34 and 38 will now be described. As the apparatus 10 displaces itself across the floor of a swimming pool, the main floats 34 will remain in the position shown in FIG. 1. As the apparatus 10 then moves onto a wall portion the lever arms 42 will pivot till eventually the main floats 34 lie between the pipes 14.1 and 14.2, further displacement of the floats 34 and their lever arms 42 being prevented by engagement of the connectors 52 with the pipe 14.1. If the tilting float 38 was not provided, the floats 34 would remain in this position until the coupling 20 is below the head 16. However, due to the buoyant force experienced by the tilting float 38, it is caused to pivot about the pipe 14.1, thereby tilting the pivot pin 44 about the tilting axis 40. It will be appreciated, that the more the pipes 14.1, 14.2 are canted the greater will be the pivoting force exerted on the tilting float 38. At a predetermined canting angle, the main floats 34 and their lever arms 42 will be free to pivot and the main floats 34 will pivot away from the pipe 14.1. This causes the effective centre of gravity of the apparatus 10 to be displaced towards the coupling 20 thus causing the apparatus 10 to be canted over further. Eventually, when the coupling 20 is located below the head 16, the main floats 34 will pivot right over until the lever arms 42 engage the head 16. The apparatus 10 then migrates down the wall back onto the floor, whereupon the main floats 34 return to the position shown in FIG. 1.

It will further be understood, if the apparatus 10 loses adhesion with the wall and falls to the floor, the action of the main floats 34 and the tilting float 38 will cause the body 12 to assume the desired attitude so that the mouth 22 of the head 16 engages the floor.

I claim:

1. A flexible disc for a cleaning head of an apparatus that cleans a surface submerged in a liquid, said cleaning head including a mouth engageable with the surface to be cleaned, said disc comprising a substantially planar member fabricated from a resiliently flexible material, said member including a central aperture within which said cleaning head is receivable for detachably interconnecting said disc and said cleaning head, a series of concertina-like folds in an outer annular portion of said disc, said concertina-like folds extending radially outward relative to said central aperture, and said concertina-like folds permitting the outer periphery of said disc to be resiliently extensible around the outer periphery of said disc, and a series of grooves in one surface of said disc which extend from the outer periphery of said disc through said outer annular portion into an inner annular portion of said disc, said grooves also extending radially outward relative to said central aperture, and said grooves being located in that disc surface adapted to engage the surface to be cleaned, said flexible disc cooperating with said cleaning head during use of said apparatus for retaining said mouth in cleaning proximity with the surface to be cleaned and for assisting in removal of dirt from that surface.

* * * * *